US008242400B2

(12) United States Patent
Bigand

(10) Patent No.: US 8,242,400 B2
(45) Date of Patent: Aug. 14, 2012

(54) DATA INPUT DEVICE WITH ENHANCED TACTILE SENSATION

(75) Inventor: Jean-Louis Bigand, Vendome (FR)

(73) Assignee: Thales, Neuilly-sur-Seine (FR)

( * ) Notice: Subject to any disclaimer, the term of this patent is extended or adjusted under 35 U.S.C. 154(b) by 305 days.

(21) Appl. No.: 12/627,301

(22) Filed: Nov. 30, 2009

(65) Prior Publication Data

US 2010/0133079 A1 Jun. 3, 2010

(30) Foreign Application Priority Data

Nov. 28, 2008 (FR) ..... 08 06704

(51) Int. Cl.
*H01H 13/14* (2006.01)

(52) U.S. Cl. ..... 200/521; 200/520

(58) Field of Classification Search ..... 200/16 R–16 D, 200/4, 520, 521, 537–539, 547, 548, 564–566, 200/424, 425, 430, 436–439, 446–450, 453, 200/457, 459, 434

See application file for complete search history.

(56) References Cited

U.S. PATENT DOCUMENTS

| | | | | |
|---|---|---|---|---|
| 2,347,874 | A * | 5/1944 | Bluemle | 200/430 |
| 2,603,725 | A * | 7/1952 | Dietrich | 200/38 B |
| 2,816,966 | A * | 12/1957 | Brown | 200/5 R |
| 2,927,168 | A * | 3/1960 | Brown | 200/18 |
| 4,233,479 | A * | 11/1980 | Karpe et al. | 200/430 |
| 5,012,056 | A * | 4/1991 | Abel et al. | 200/519 |
| 5,945,647 | A * | 8/1999 | Hoskins | 200/18 |
| 7,211,758 | B2 * | 5/2007 | Lui | 200/447 |
| 7,637,181 | B2 * | 12/2009 | Raymond | 74/527 |
| 2007/0074956 | A1 * | 4/2007 | Koehler et al. | 200/4 |

* cited by examiner

*Primary Examiner* — Michael Friedhofer
(74) *Attorney, Agent, or Firm* — Baker & Hostetler LLP

(57) ABSTRACT

The invention relates to a data input device produced by means of a switch operated by a stem. A return spring enables the stem to return to a stable position. According to the invention, the device comprises a circular element that can be displaced roughly perpendicularly to the displacement of the stem, a cam attached to the stem, and elastic means holding the circular element pressed against the cam, the cam comprising a slope, a high point and a counter-slope on which the circular element bears in succession when the stem is operated from its stable position to a position in which the switch is operated.

11 Claims, 6 Drawing Sheets

FO
10,000
9,000
8,000
7,000
6,000
5,000
4,000
3,000
2,000
1,000
0,000
Travel
0,00
0,10
0,20
0,30
0,40
0,50
0,61
0,67
0,77
0,87
0,96
1,06
1,16
1,26
1,36
1,46
1,56
1,66
1,76
1,86
1,96
2,06
2,16

27a
41a
26a
30a
25a
30b
26b
25b
27b 24
22
27a 24
22
27a
41a
26a 24
22
26a 24
22
26a
30a
25a 24
22
26a
27a
25a
25b
26b
27b
40

DATA INPUT DEVICE WITH ENHANCED TACTILE SENSATION

CROSS-REFERENCE TO RELATED APPLICATIONS

This application claims priority of foreign French patent application no. FR 0806704, filed Nov. 28, 2008, the disclosure of which is hereby incorporated by reference in its entirety.

BACKGROUND OF THE INVENTION

The invention relates to a data input device produced by means of a switch operated by a stem.

The invention is particularly applicable for a stem that can be pulled or pushed about a stable position. The two displacements of the stem, pull and push, can each be used to enter a data item. For each direction of displacement of the stem, the switch is generally placed at one end of the stem. An operator pulls or pushes the stem, causing the corresponding switch to be operated. The stem can also be used to operate a rotary coder wheel about the translation axis of the stem. The data obtained from the rotary coder wheel can be coded optically in an electronic part of the device.

In such a device, it is desirable to generate a tactile sensation, the main function of which is to ensure that the electrical triggering of the switch is ensured after passing a peak of force. For a good tactile sensation, it is necessary for the clearance to be significant, for example greater than a millimeter. Such devices are found in the aeronautical industry and more particularly in aircraft instrument panels. The flight safety of the aircraft may depend on the data input carried out by means of the device. This is why many manufacturers impose severe constraints in the tactile feedback that a pilot must feel when operating the device.

For this, the applicant has attempted to produce this function by means of a ball cooperating with the stem. More specifically, on the stem there is formed a cam comprising an inclined face followed by a plane parallel to the displacement axis of the stem. The ball can be displaced perpendicularly to the displacement axis of the stem by bearing on the cam by means of a spring. At rest, the stem is in a stable position. This position is held by a return spring that can be compressed along the displacement axis of the stem. In this stable position, the ball is in contact with the cam at the bottom of the inclined face. When the stem is actuated by an operator, the ball rises on the inclined face while compressing its spring until the parallel plane is reached. The force exerted by the ball on the cam is added to that exerted by the return spring of the stem. When the ball is in contact with the parallel plane, the force added by the ball, returned on the displacement axis of the stem, is almost zero, friction apart, and the only force that the operator has to overcome is that generated by the return spring of the stem. However, when the ball is in contact with the inclined face, it exerts an axial force component on the stem. This axial component, added to the force generated by the return spring, forms a peak of force that the operator must overcome by actuating the stem.

The accuracy of these systems depends notably on the diameter of the ball and its position on the inclined face in the stable position, which imposes tight production tolerances. The peak of force depends on the diameter of the ball, on the force exerted by the spring of the ball and on the slope of the inclined face. In a curve giving the force exerted on the stem as a function of the displacement of the latter, the slope of the return curve of the stem depends on the stiffness of the return spring and on the friction force of the ball on the cam.

These systems require ball diameters, a compression force of the balls and a length and height of the slope of the click that are significant to have a mechanical travel and a dip in force that are significant for large clearances with an identifiable tactile sensation. The significant compression forces of the balls demand superficially hard materials to sustain the wear of the repeated operations.

Furthermore, after numerous operations, the wear of the cam and of the ball affects the tactile sensation by increasing the depth of displacement between the maximum force at the peak and the minimum force that follows.

The invention aims to overcome all or some of the problems cited above.

SUMMARY OF THE INVENTION

The present invention provides a data input device with tactile sensation for which the force on the ball, and therefore the ultimate wear of the device, is reduced.

The present invention provides a data input device including:

- a switch making it possible to input data,
- a stem that is mobile relative to a module, the stem making it possible to operate the switch,
- a return spring enabling the stem to return to a stable position in which the stem is not operated, and
- means for modulating a force exerted by the return spring in order to define a peak of force at a point of the travel of the stem beyond which the switch is operated, wherein the means for modulating the force comprise

- a circular element that can be displaced roughly perpendicularly to the displacement of the stem,
- a cam attached to the stem,
- elastic means holding the circular element pressed against the cam, the cam comprising a slope, a high point and a counter-slope on which the circular element bears in succession when the stem is operated from its stable position to a position in which the switch is operated.

By convention, the slope is defined as a surface that is angularly offset relative to the direction of the displacement of the stem. The orientation of the angle is such that the force exerted by the circular element on the stem opposes the displacement of the stem from its stable position. The counter-slope is also defined as a surface that is angularly offset relative to the direction of the displacement of the stem. However, the orientation of the angle of the counter-slope is reversed compared to that of the slope so that the force exerted by the circular element on the stem tends to facilitate the displacement of the stem from its stable position.

The invention makes it possible to ensure that the displacement of the stem cannot be stopped physically before the switch is engaged.

BRIEF DESCRIPTION OF THE DRAWING

The invention will be better understood, and other advantages will become apparent, from reading the detailed description of an embodiment given by way of example, the description being illustrated by the appended drawing in which.

In the interests of clarity, the same elements will be given the same identifiers in the different figures.

DETAILED DESCRIPTION OF THE PREFERRED EMBODIMENT

The description that follows is given in relation to a data input device comprising a switch making it possible to input the data item, a stem that is mobile translation-wise relative to a module and a return spring enabling the stem to return to a stable position in which the stem is not operated. The displacement translation-wise of the stem makes it possible to operate the switch. Obviously, the invention can be implemented in a rotary selector switch in which a displacement rotation-wise of the stem is used to operate the switch. In other words, the stem is mobile rotation-wise relative to the module and the rotation of the stem makes it possible to input a data item represented by the angular position of the stem.

Hereinafter, the switch will not be described. Any type of switch operated by the movement of a mobile part can be used. The stem serves as an intermediary between the operator and the mobile part of the switch. The switch is, for example, a pushbutton operated translation-wise. The switch can also be an optical coder wheel comprising a mask attached to the stem and being able to be displaced between an emitter and a detection cell, the emitter and the detection cell being attached to the module. The use of an optical coder wheel offers the advantage of not producing force on the stem. The only forces between module and stem derive from the various component elements of the invention.

The stem is attached to the mobile part of the pushbutton and an operator exerts a force on the stem. This force is transmitted to the mobile part. The invention allows for a clear movement of the mobile part and therefore makes it possible to enhance the reliability of the data input produced by the operation of the switch.

Figure 1:
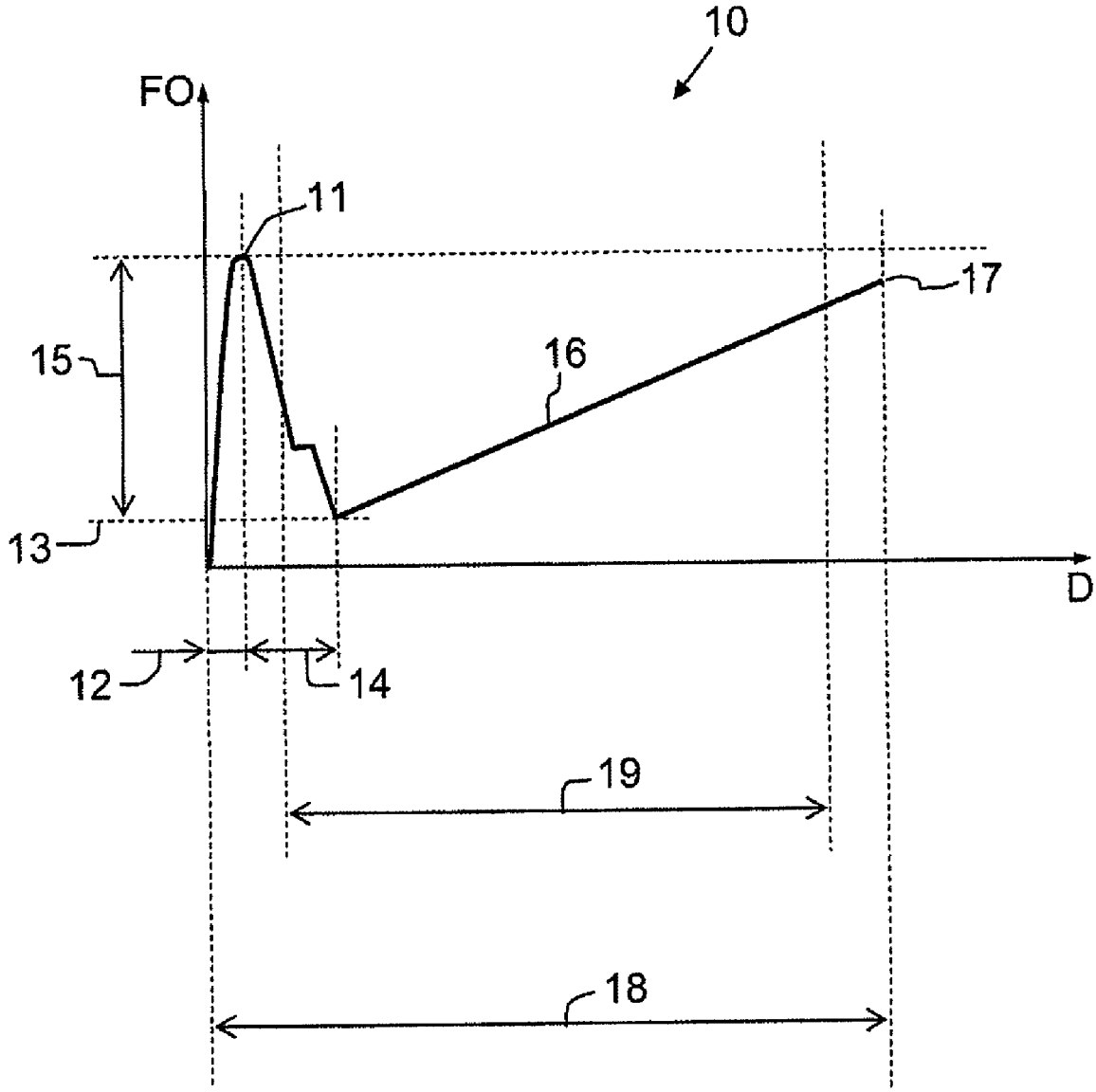
FIG. 1 represents, in a simplified manner, a curve defining the force to be applied to the stem as a function of the travel of the latter.

The device comprises means for modulating a force exerted by the return spring in order to define a peak of force at a point of the travel of the stem beyond which the switch is operated; FIG. 1 illustrates this peak of force. More specifically, FIG. 1 represents an exemplary curve 10 defining the force FO to be applied to the stem, on the Y axis, as a function of the displacement or travel D of the latter represented on the X axis.

At the origin of the marker, no force is exerted on the stem and it is in a stable position. From this position, to begin the displacement of the stem, the force must increase rapidly until it reaches a maximum 11 hereinafter called peak. This first part of the displacement of the stem is marked 12. Beyond the peak 11, the force to continue the displacement of the stem decreases to reach a minimum 13. Between the peak 11 and the minimum 13, the part of the displacement relating thereto is called depth of displacement 14. The difference between the value of the peak and that of the minimum is called force dip 15. Beyond the depth of displacement 14, the curve 10 enters into a part 16 that is linear and increasing until a force value 17 is reached, obtained at the end of the travel of the stem. An end stop can be provided to stop the stem. The whole of the travel of the stem is represented by a dimension 18.

The electrical contact of the switch must be made after the peak of force 11 and before the end of the travel. The part of the travel in which the switch is operated is represented by the dimension 19. To ensure that the switch is indeed operated when the stem is operated by an operator, it is important for the force value 17 to be less than that of the peak of force 11. It will be shown hereinafter how, thanks to the invention, the force value 17 can be adjusted.

Figure 2:
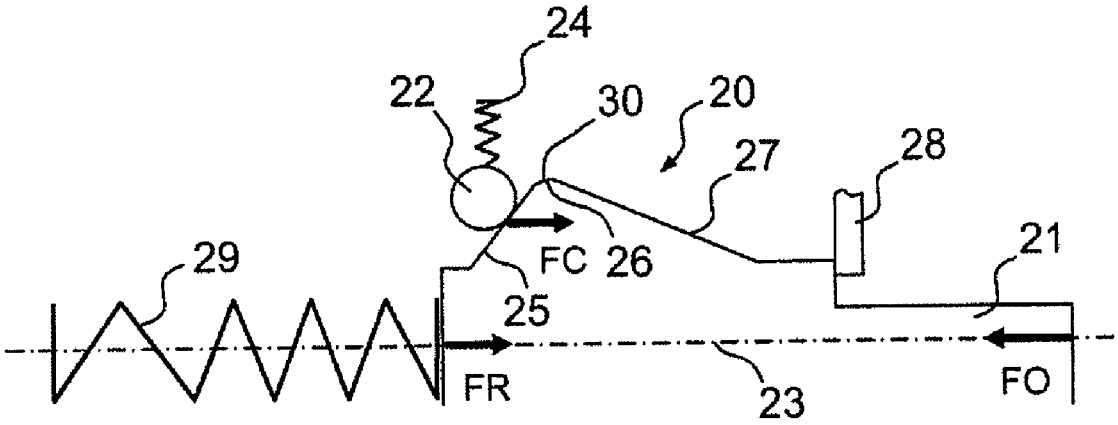
FIGS. 2 and 3 diagrammatically represent the forces exerted on the stem at two positions of its travel.

FIG. 2 diagrammatically represents the forces exerted on the stem when it is in the stable position. The device comprises a cam 20 attached to the stem 21 and a circular element 22 that can be displaced roughly perpendicularly to the displacement of the stem 21. The displacement of the stem 21 is made translation-wise along an axis 23. The circular element 22 is held bearing against the cam 20 by means of a spring 24.

The cam 20 comprises a slope 25, a high point 26 and a counter-slope 27 on which the circular element 22 bears in succession when the stem 21 is operated from its stable position to a position in which the switch is operated. The circular element 22 can be rigid: a spherical ball or a cylinder whose axis is perpendicular to the plane of FIG. 2. A cylindrical shape makes it possible to better distribute the force exerted by the circular element 22 against the cam 20 and therefore reduce the wear of the cam 20 and of the circular element 22. Alternatively, the circular element and the elastic means holding the circular element pressed against the cam 20 can be produced by means of a single mechanical part such as, for example, an elastic ring. The external circular shape of the ring is in contact with the cam 20 and the elasticity of the ring makes it possible to hold it bearing against the cam 20 all along the displacement of the stem 21.

The device also comprises a return spring 29 opposing the displacement of the stem 21 and therefore being able to be compressed along the axis 23. In the stable position, the stem abuts against the module 28, the return spring 29 is compressed so as to hold the stem 21 against the module 28 and the circular element 22 is bearing on the slope 25.

To separate the stem 21 from the module 28, an operator exerts, on the stem 21, a force FO directed towards the left in FIG. 2. It is the trend of this force that is represented in FIG. 1. In this position, the stem 21 is stable under the action of two other forces, FR exerted by the return spring 29 and the axial component FC exerted by the circular element 22 on the stem 21. To avoid complicating the description, no account is taken of the radial component of the force exerted by the circular element 22 on the stem 21. This radial component is taken by a bearing that is not represented and handling the guidance translation-wise of the stem 21 along the axis 23. The radial component can also be taken by a second assembly formed by a cam, a circular element and a spring. This second assembly is positioned in the data input device in a manner symmetrical to the first assembly formed by the cam 20, the circular element 22 and the spring 24 represented in FIG. 2. The symmetry of the two assemblies is produced relative to the axis 23. The sum of the axial and radial components exerted by the circular element 22 on the stem 21 is roughly perpendicular to a plane tangential to the cam 20 at the point of contact between the circular element 22 and the cam 20. In this breakdown, no account is taken of the friction forces that could be taken into account in a more detailed modelling.

The forces FR and FC are oriented in the same direction towards the right in FIG. 2. When the circular element 22 is bearing against the slope 25, the stem 21 is in its first part 12 of displacement and the force FO to be exerted by the operator increases rapidly, on the one hand because the forces FC and FR are in the same direction and on the other hand because the force FC increases because of the increase in compression of the spring 24 holding the circular element 22 bearing against the cam 20.

Figure 3:
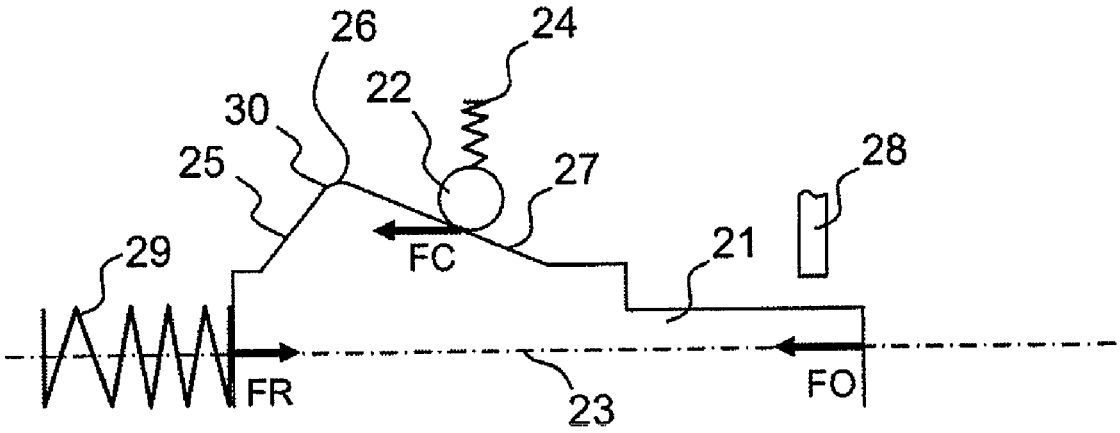

At the end of the first part 12 of the displacement of the stem 21 towards the left of FIG. 2, the circular element 22 reaches the high point 26. This high point constitutes the junction between the slope 25 and the counter-slope 27. Upon this passage about the high point 26, the force FC changes direction to be oriented towards the right in FIG. 2. FIG. 3 represents the position of the step 21 after the passage of the stem 21 about the high point 26. The depth of displacement 14 corresponds to the passage of the circular element about the high point 26. The change of orientation of the force FC makes it possible to obtain the force dip 15. A detachment may appear in the curve 10 between the peak of force 11 and the minimum 13. This detachment corresponds to the passage of the circular element 22 at the level of the high point 26.

When the circular element 22 is bearing against the counter-slope 27, the forces FC and FR change linearly as a function of the respective compression of the springs 24 and 29 which corresponds to the linear part 16 of the curve 10. The slope of the linear part 16 can be adapted by modifying the inclination of the counter-slope 27 and thus ensure that the force value 17 is less, even significantly less, than that of the peak of force 11 while remaining positive in order to enable the stem 21 to return to its stable position if the force FO exerted by the operator is relaxed.

More generally, the dimensions of the cam 20 are defined so that a force FO exerted on the stem 21 all along a part 19 of the travel of the stem 21, a part in which the switch is operated, is less than the peak of force 11.

In the absence of a counter-slope 27, that is to say when the slope is followed by a flat surface parallel to the axis 23, the depth of the displacement 14 is roughly equal to the radius of the circular element 22 multiplied by the sine of the angle of the slope 25 relative to the axis 23. By implementing the invention, the depth of the displacement is elongated by the radius of the circular element 22 multiplied by the sine of the angle of the counter-slope 27 relative to the axis 23. It is thus possible, for one and the same depth of displacement 14, to reduce the radius of the circular element 22, which makes it possible to reduce the footprint of the device.

Furthermore, the presence of the counter-slope 27 allows for a greater dip in the force 15 because of the reversal of direction of the force FC. With no counter-slope 27, the force FC is simply cancelled when the circular element 22 arrives on the flat surface parallel to the axis 23. It is thus possible, for a given dip in force 15, to reduce the force exerted by the spring 24 by implementing the invention. This reduction in force makes it possible to reduce the wear of the cam 20 and of the circular element 22. It is also possible to use softer and less expensive materials. In one embodiment of the invention, it was, for example, possible to replace a metal cam 20 with a cam 20 made of plastic material while retaining the same lifespan for the device, a lifespan that is, for example, measured in terms of number of operations.

Advantageously, when the stem 21 is in its stable position, the circular element 22 is bearing on the cam 20 at the level of a junction 30 between the slope 25 and the high point 26. Thus, in the stable position, the force FC is oriented in the direction opposite to the force FO, hence a significant force to be overcome by the operator to separate the stem 21 from its abutment against the module 28. Then, at the start of the travel of the stem 21, the force FC reduces. This makes it possible to strongly reduce, even eliminate, the first part 12 of the displacement of the stem 21. Thus, for the operator to feel a displacement of the stem 21, he has to exert a force almost equal to the peak of force 11. This leads to a depression of the stem 21 almost coinciding with the start of its displacement and therefore an enhancement of the reliability of operation of the switch.

Figures 4, 4A, 4B, 4C, 4D, 4E, 4F:
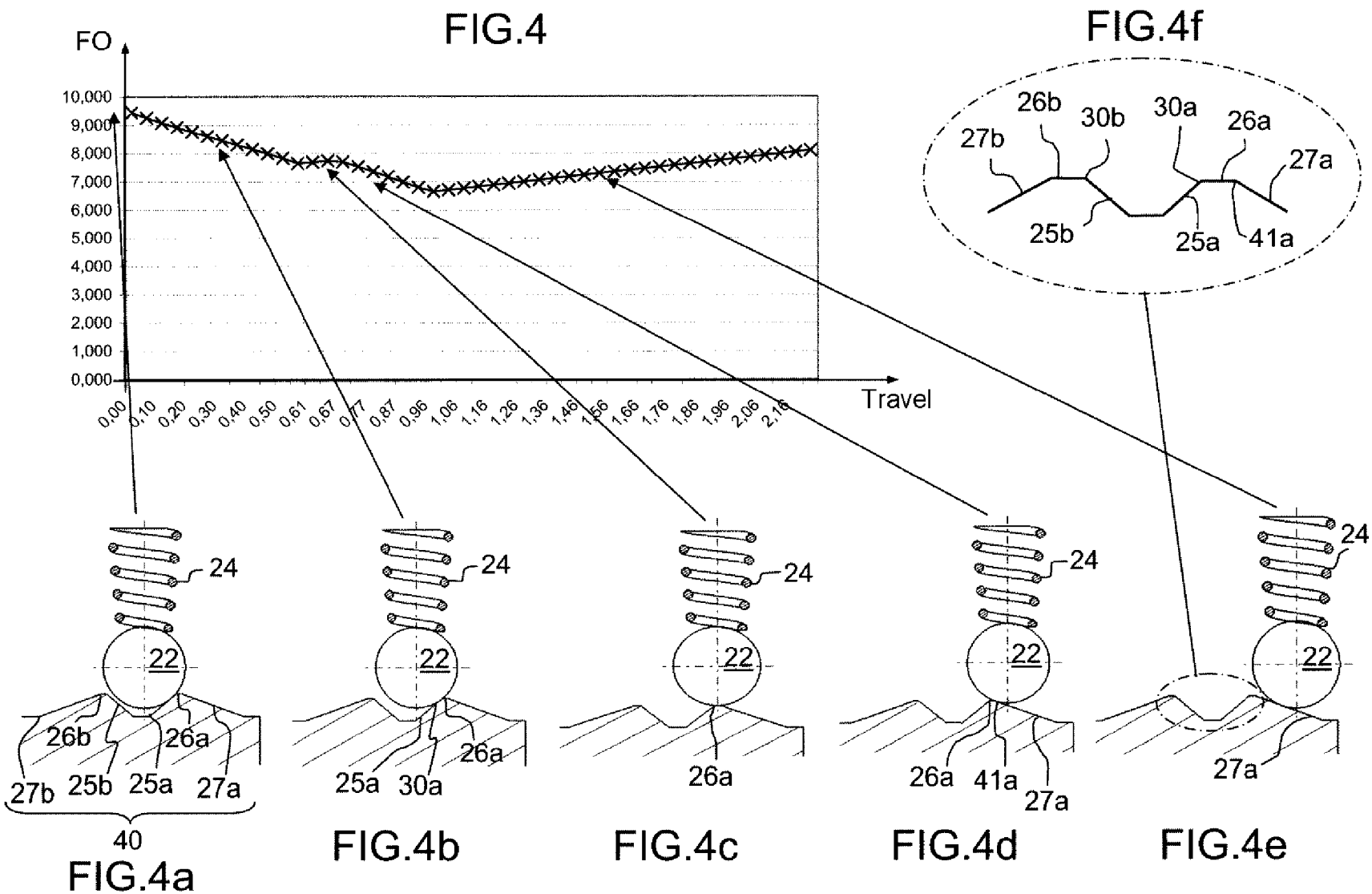
FIG. 4 represents, in more detail, in an exemplary embodiment with double switch, a curve defining the force to be applied to the stem as a function of the travel of the latter.
FIGS. 4*a* to 4*f* represent a number of positions of the stem associated with the curve of FIG. 4.

The device can comprise a second switch. The means for modulating the force make it possible to create a second peak of force in the travel of the stem beyond which the second switch is operated. This variant is explained using FIGS. 4 to 4*f*. The device comprises only a single circular element 22 which can be displaced along a cam 40 comprising two slopes 25*a* and 25*b*, two high points 26*a* and 26*b* and two counter-slopes 27*a* and 27*b* on which the circular element 22 bears in succession when the stem 21 is operated from its stable position. The areas 25*a*, 26*a* and 27*a* of the cam 40 are similar to the areas 25, 26 and 27 already described and the areas 25*b*, 26*b* and 27*b* bear the circular element 22 when the stem 21 is displaced towards a position in which the second switch is operated. FIG. 4*f* represents an enlarged view of the cam 40 on its own.

Advantageously, the two slopes 25*a* and 25*b*, the two high points 26*a* and 26*b* and the two counter-slopes 27*a* and 27*b* are respectively symmetrical relative to the same point of the cam 40, the point situated between the two slopes 25*a* and 25*b*. The stable position of the stem 21 is obtained when the circular element 22 is simultaneously bearing on the two slopes 25*a* and 25*b*. It is not absolutely necessary to provide an abutment against the module 28 to hold the stem 21 against its stable position.

FIG. 4 represents a curve of the force FO, on the Y axis, expressed in Newtons and exerted on the stem 21 by the operator, as a function of the displacement of the stem 21 on the X axis and expressed in millimeters. The curve illustrates the displacement of the stem 21 only in a single direction from the stable position.

In the position of the stem 21 represented in FIG. 4*a*, the circular element 22 is bearing on the slope 25*a* and is slightly separated from the slope 25*b*. In this position, the force FO has a value of the order of 9.5N corresponding to the peak of force 11.

In the position of FIG. 4*b*, the circular element 22 is bearing on the cam 40 at the level of a junction 30*a* between the slope 25*a* and the high point 26*a*. During the corresponding displacement of the stem 21, the curve of FIG. 4 decreases to reach a value of the order of 7.5N at the point where the circular element completely leaves the slope 25*a* to follow the high point 26*a*. This area of the cam 40 formed by the high point 26*a* is, for example, a small surface roughly parallel to the axis 23 of displacement of the stem 21. When the circular element 22 is displaced along the high point 26*a*, represented in FIG. 4*c*, the force FO becomes an increasing force. If an absence of friction is assumed, this increase in force FO as a function of the displacement of the stem 21 is due to the action of the return spring 29 whose stiffness is assumed constant. The force FC due to the circular element 22 is zero.

In the position of FIG. 4*d*, the circular element 22 is bearing on the cam 40 at the level of a junction 41*a* between the high point 26*a* and the counter-slope 27*a*. In this position, the force FC increases as an absolute value from a zero value, when the circular element 22 is bearing on the high point 26*a*, to a maximum value, when the circular element 22 completely leaves the high point 26*a* to follow the counter-slope 27*a*. The force FO then has a value of the order of 6.5N. Beyond this point, the circular element 22 follows the counter-slope 27*a* and the curve of FIG. 4 is linear and increasing as in the part 16 of the curve 10.

In FIG. 4, the origin of the displacements of the stem 21 is the stable position of the stem 21 and the curve represented in FIG. 4 can be used to deduce a symmetrical curve when the circular element 22 follows the areas 25*b*, 26*b* and 27*b* of the ramp when the stem 21 is displaced by the operator towards the negative X axes.

The peak of force 11 is in this case obtained from the stable position, because the circular element 22 is bearing against the junction 30*a*. By adapting the shapes of the cam 40 and that of the circular element 22, so that, in the stable position, the circular element 22 is both bearing against the junction 30*a* and a junction 30*b* between the slope 25*b* and the high point 26*b*, there is obtained a coincidence of the peaks of force obtained at the same point of the travel of the stem 21, in other words in the stable position.

Figure 5:
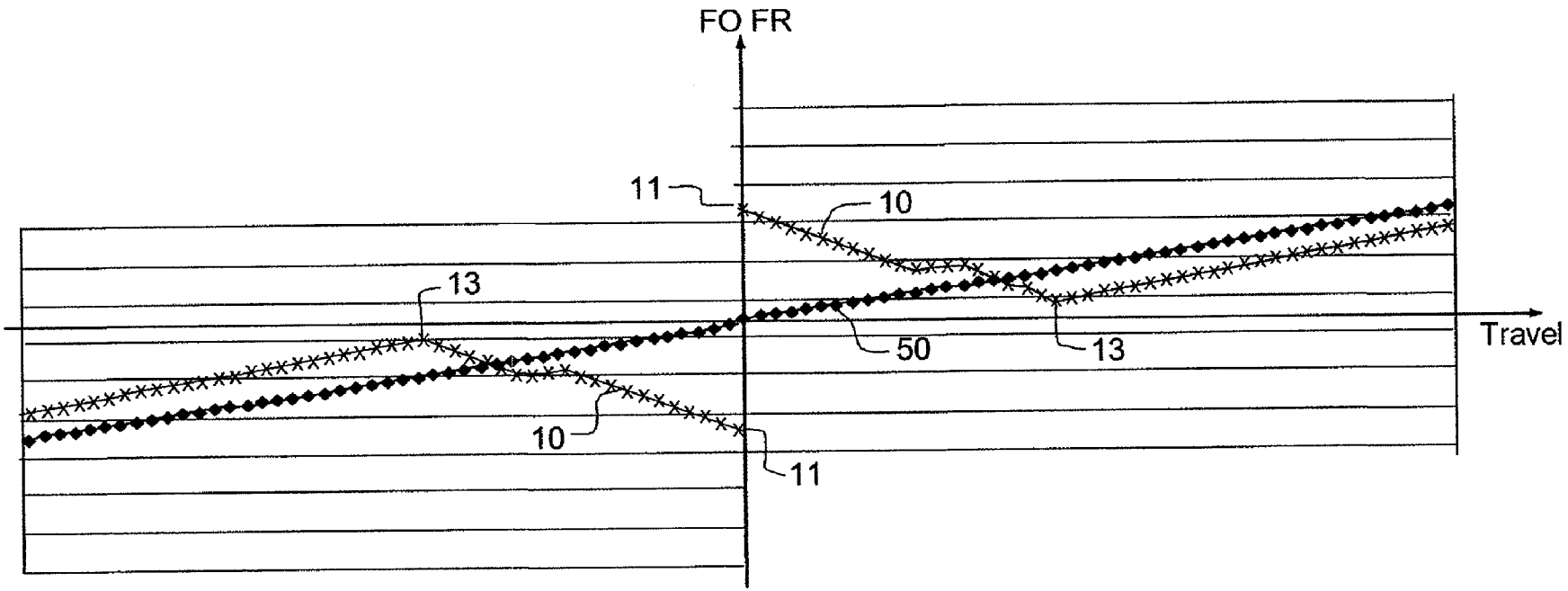
FIG. 5 represents, as in FIG. 1, the force to be applied to the stem as a function of the travel of the latter, and the force exerted by a return spring.

FIG. 5 represents a graph obtained for a device with two switches that can be operated translation-wise about a stable position defined by a single return spring that can be compressed or stretched. It is also possible to define this stable position by means of two preloaded and antagonistic springs. The two springs bear both on the module 28 and on the stem 21. In the stable position, the forces exerted by each of the springs are equal as an absolute value and opposite in direction. This graph defines the curve 10 as for FIGS. 1 and 4 with, on the X axis, the travel of the stem 21 and on the Y axis the force FO to be applied to the stem 21 to displace it. The curve 10 is symmetrical relative to the origin of the marker of this graph. Also represented is a curve 50 representing the return force FR as a function of the travel of the stem 21. The curve 50 is a straight line passing through the origin of the graph. The curve is obtained either with a return spring or with two antagonistic springs with constant stiffness or stiffnesses.

This embodiment makes it possible to define two peaks of force 11, one negative and the other positive, both placed on the vertical axis as for FIG. 4, but presents a number of drawbacks. The minimums 13 of the first and third quadrants are close to the horizontal axis of the graph. The wear of the device can degrade the shape of the curve 10 and, if a minimum 13 were to pass to the other side of the horizontal axis, the stem 21 would no longer return to its stable position. Furthermore, if the stable position is defined when the circular element 22 is bearing simultaneously on the two slopes 25*a* and 25*b*, it is necessary to adjust the loading of the return spring or springs so that, in this stable position, the curve 50 indeed passes through the origin of the marker. In other words, in the stable position, the spring or springs must apply no force on the stem 21.

Figure 6:
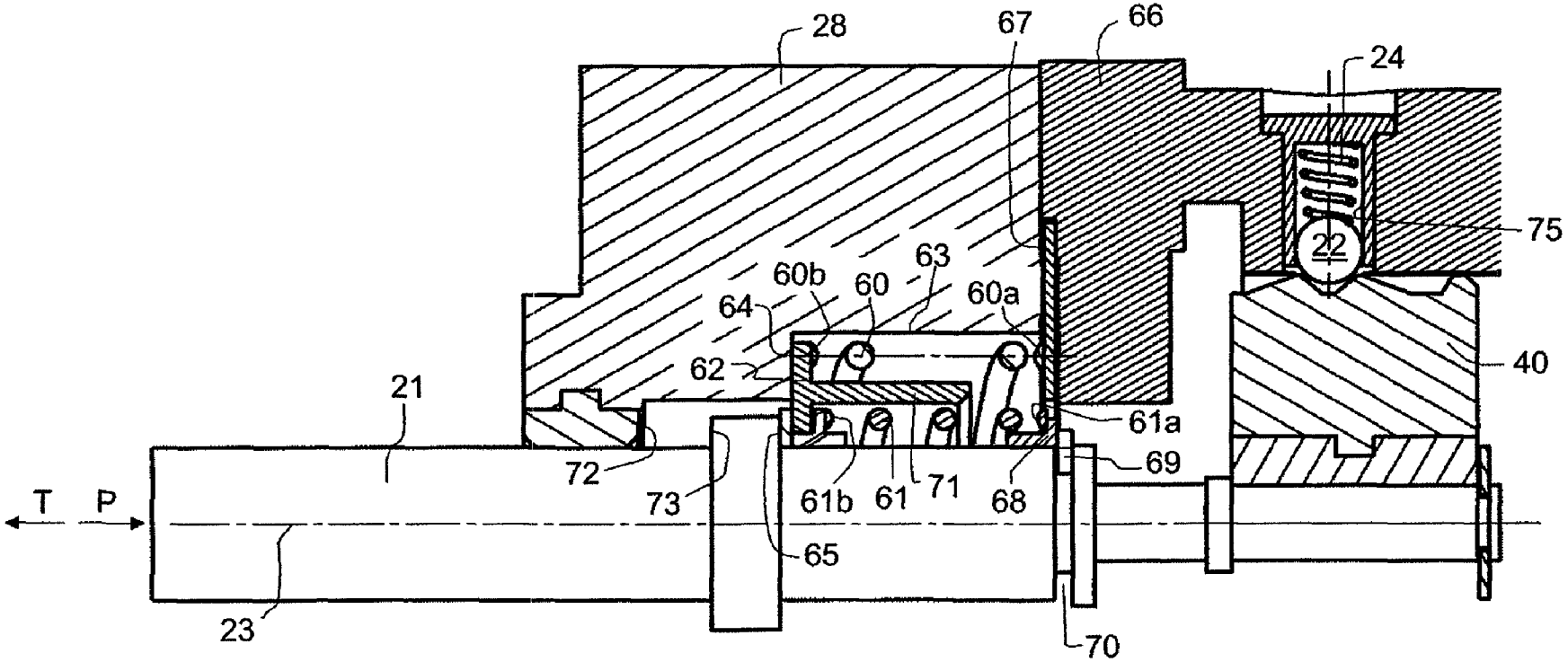
FIG. 6 represents an exemplary embodiment in which two return springs operate without being antagonistic.

FIG. 6 illustrates a solution to these drawbacks. The device comprises two return springs 60 and 61. The two return springs 60 and 61 are positioned so that just one of the return springs 60 or 61 is compressed when the stem 21 leaves its stable position, the other return spring 60 or 61 remaining in the state of the stable position. Thus, the two springs 60 and 61 operate independently of one another. In an exemplary embodiment of this independence, the device comprises a bearing piece 62 that can be displaced relative to the stem 21 and relative to the module 28. In the stable position, the bearing piece 62 is bearing against the module 28 and against the stem 21. The first return spring 60 bears between the module 28 and the bearing piece 62 and the second return spring 61 bears between the stem 21 and the bearing piece 62. The two springs 60 and 61 exert a force on the bearing piece 62 in the same direction.

The stable position does not depend on the tension of the return springs 60 and 61. The stable position is defined by the bearing of rigid mechanical parts against one another, namely the bearing piece 62 both against the stem 21 and against the module 28.

In the example represented, the stem 21 is displaced translation-wise along the axis 23 to operate the two switches. The bearing piece 62 is a piece of revolution having the shape of a washer passed through by the stem 21 and being able to be displaced translation-wise along the stem 21 in a bore 63 of axis 23 of the module 28. In the stable position, the bearing piece 62 bears against a bottom 64 of the bore 63. In this same position, the bearing piece 62 bears against a shoulder 65 of the stem 21.

The two springs 60 and 61 are helical and are fitted concentrically about the axis 23. The bore 63 is partially closed by a cover 66 on which bears the spring via a first of its ends 60*a*, possibly through the intermediary of a washer 67. A second end 60*b* of the spring 60 bears against the bearing piece 62. The stem 21 passes through the washer 67 and the cover 66. The spring 61 bears at a first of its ends 61*a* against a washer 68 attached to the step 21. A second end 61*b* of the spring 61 bears against the bearing piece 62. The washer 68 is joined to the stem 21 by means of a circlip 69 positioned in a groove 70 of the stem 21.

When an operator pushes on the stem 21 along the axis 23, the direction of displacement of the stem 21 being embodied by the arrow P, only the spring 60 is compressed. The stem 21 is displaced relative to the module 28 and drives the bearing piece 62 in its displacement relative to the module 28, which compresses the spring 60. The bearing piece 62 can include a tubular extension 71 making it possible to limit the displacement of the bearing piece 62 in the bore 63. The extension 71 can abut against the washer 67 to limit the displacement of the stem 21 in the "push" direction P. However, the bearing piece 62 remains bearing against the shoulder 65. The washers 62 and 68 both follow the displacement of the stem 21. Thus, the spring 61 is not deformed when the operator pushes on the stem 21.

Conversely, when an operator pulls on the stem 21 along the axis 23, the direction of displacement of the stem 21 being embodied by the arrow T, only the spring 61 is compressed. The bearing piece 62 remains bearing against the bottom 64 of the bore 63. The spring 60 is therefore not deformed. It is also possible to provide a mechanical abutment limiting the displacement of the stem 21 in the "pull" direction T. This abutment can be formed by a surface 72 of the module 28 on which bears a shoulder 73 of the stem 21. However, the washer 69 follows the movement of the stem 21 and compresses the spring 61 against the bearing piece 62.

FIG. 6 also shows the cam 40 attached to the stem 21, the circular element 22 and the spring 24 both being able to slide in a radial recess 75 of the cover 66. In the variant in which an elastic ring is in contact with the cam 20, the spring 24 disappears and only the elastic ring is situated in the recess 75. In the example represented in FIG. 6, the precise definition of the stable position produced by means of the two return springs 60 and 61 complements means for modulating the force of the return springs 60 and 61, means involving the cam 40 and the circular element 22. Obviously, it is possible to implement the precise definition of the stable position without means for modulating the force of the return springs 60 and 61.

Figure 7:
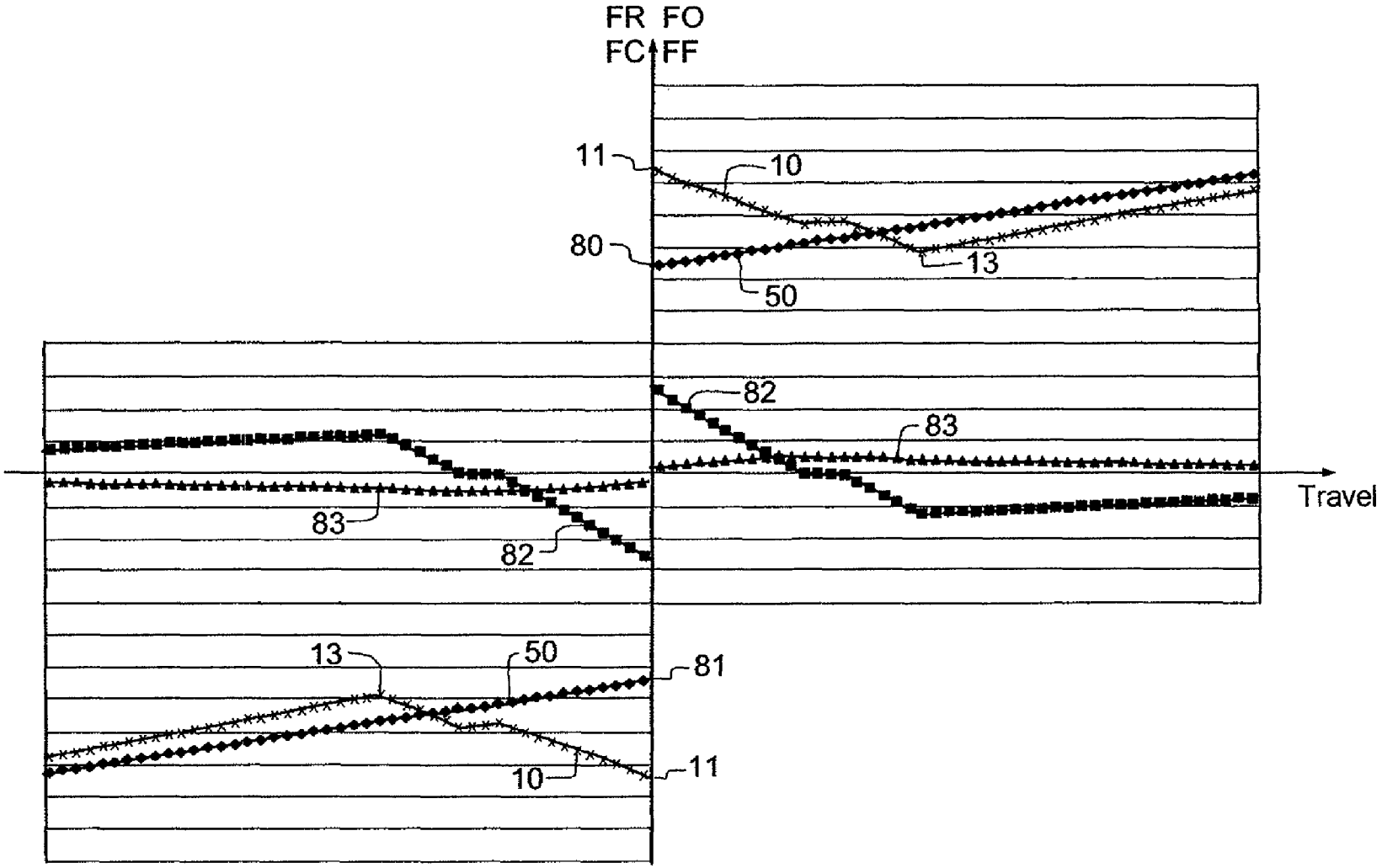
FIG. 7 represents, as in FIG. 1, the axial components of the various forces involved in the exemplary embodiment defined in FIG. 6.

FIG. 7 represents the axial components of the various forces involved in the exemplary embodiment defined in FIG. 6. The curve 50, representing the return force FR as a function of the travel of the stem 21, is linear in each of the quadrants in which it is present. The linearity is due to the stiffness of each spring 60 and 61. In this case, the two springs 60 and 61 have the same stiffness and the slope of the curve 50 is the same for the two quadrants. Obviously, it is possible to use springs 60 and 61 that have different stiffnesses which would lead to different slopes in each of the quadrants in which the curve 50 is present. Unlike FIG. 5, the curve 50 of FIG. 7 includes a jump at the level of the vertical axis. For the first quadrant of positive X and Y axes, the Y axis at the origin has a positive value 80. For the third quadrant, of negative X and Y axes, the Y axis at the origin has a negative value 81. The two Y axes at the origin 80 and 81 represent the loading or prestressing of the corresponding return spring 60 or 61. This is a force that the return springs and 61 exert when the device is in its stable position. This loading can be equal or different for the two return springs 60 and 61. This loading makes it possible to increase the values of the peaks of force 11 and of the minimums 13 of each quadrant and more generally to offset the curves 10.

FIG. 7 also shows a curve 82 representing the variation of the force FC as a function of the travel. In the first quadrant, the curve 82 corresponds to the trend of the force FC explained by means of FIGS. 2 and 3. When the circular element 22 is in contact with the junction 30, the value of the force FC is positive. When the circular element 22 is in contact with the high point 26, the force FC is zero and when the circular element 22 is in contact with the counter-slope 27, the value of the force FC is negative.

To refine the modelling of the device, a curve 83 has been used to represent the trend of a friction force FF of the circular element 22 in its displacement along the cam 40 moving away from the stable position. The value of the force FF has the same sign as the force FR when the cam 40 moves away from the stable position. The sign of the value of the force FF is reversed when the cam returns to the stable position. To avoid cluttering FIG. 7, only the positive friction force FF has been represented.

The force FO that the operator must exert on the stem 21 to displace it is equal to the sum of the forces FR, FC and FF. In FIG. 7, the curve 10 represented is the force FO when the stem is moving away from the stable position. Because of the negative sign of the friction force FF, the curve 10, not represented here, would approach the horizontal axis when the stem 21 returns to the stable position. The loading of the return springs 60 and 61 can take account of the friction force FF to prevent the minimums 13 from having excessively low values, which would risk causing the stem to fail to return to the stable position.

It will be readily seen by one of ordinary skill in the art that embodiments according to the present invention fulfill many of the advantages set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A data input device comprising:

a switch making it possible to input data, a stem that is mobile relative to a module, the stem configured to move from a stable position when subjected to an applied force, making it possible to operate the switch, a return spring forcing the stem to return to the stable position when the stem is not subjected to the applied force, and means for modulating a force exerted by the return spring in order to define a peak of force at a point of travel of the stem beyond which the switch is operated, wherein the means for modulating the force further comprises a circular element that can be displaced roughly perpendicularly to the displacement of the stem, a cam attached to the stem, elastic means holding the circular element pressed against the cam, the cam comprising a slope, a high point and a counter-slope on which the circular element bears in succession when the stem is operated from its stable position to a position in which the switch is operated.

2. The device according to claim 1, wherein the dimensions of the cam are defined so that a force exerted on the stem all along a portion of the travel of the stem, a portion in which the switch is operated, is less than the peak of force.

3. The device according to claim 1, wherein, when the stem is in the stable position, the circular element is bearing on the cam at the level of a junction between the slope and the high point.

4. The device according to claim 1, further comprising a second switch, wherein the means for modulating the force make it possible to create a second peak of force in the travel of the stem beyond which the second switch is operated, and wherein the cam comprises a second slope, a second high point and a second counter-slope on which the circular element bears in succession when the stem is operated from the stable position to a position in which the second switch is operated.

5. The device according to claim 4, wherein the first and second slopes, the first and second high points and the first and second counter-slopes are respectively symmetrical relative to the same point of the cam.

6. The device according to claim 4, wherein the peaks of force are obtained at the same point of the travel of the stem.

7. The device according to claim 4, further comprising a second return spring, and wherein the two return springs are positioned so that just one of the return springs is compressed when the stem leaves the stable position, the other return spring remaining in the state of the stable position.

8. The device according to claim 7, further comprising a bearing piece that can be displaced relative to the stem and relative to the module, wherein, in the stable position, the bearing piece is bearing against the module and against the stem, and the first return spring bears between the module and the bearing piece, and wherein the second return spring bears between the stem and the bearing piece and the two return springs exert a force on the bearing piece in the same direction.

9. The device according to claim 1, wherein a displacement translation-wise of the stem relative to the module makes it possible to operate the switch.

10. The device according to claim 9, wherein the stem is mobile rotation-wise relative to the module and the rotation of the stem makes it possible to enter a data item represented by the angular position of the stem.

11. The device according to claim 1, wherein the circular element and the elastic means holding the circular element pressed against the cam are formed by an elastic ring situated in a recess of the module.

* * * * *